US011495417B2

(12) United States Patent
Lin et al.

(10) Patent No.: US 11,495,417 B2
(45) Date of Patent: Nov. 8, 2022

(54) SWITCHING APPARATUS

(71) Applicant: ABB Schweiz AG, Baden (CH)

(72) Inventors: Zeming Lin, Xiamen (CN); Qishun Guo, Xiamen (CN); Aki Suutarinen, Helsinki (FI); Sensen Huang, Xiamen (CN); Tong Wang, Xiamen (CN)

(73) Assignee: ABB SCHWEIZ AG, Baden (CH)

( * ) Notice: Subject to any disclaimer, the term of this patent is extended or adjusted under 35 U.S.C. 154(b) by 0 days.

(21) Appl. No.: 16/820,076

(22) Filed: Mar. 16, 2020

(65) Prior Publication Data

US 2020/0258696 A1 Aug. 13, 2020

Related U.S. Application Data

(63) Continuation of application No. PCT/CN2018/105826, filed on Sep. 14, 2018.

(30) Foreign Application Priority Data

Sep. 15, 2017 (CN) ..... 201710835500.0

(51) Int. Cl.
*H01H 1/22* (2006.01)
*H01H 3/28* (2006.01)
(Continued)

(52) U.S. Cl.
CPC ..... *H01H 3/28* (2013.01); *H01H 1/221* (2013.01); *H01H 3/30* (2013.01); *H01H 5/06* (2013.01);
(Continued)

(58) Field of Classification Search
USPC ..... 335/2
See application file for complete search history.

(56) References Cited

U.S. PATENT DOCUMENTS 4,020,923 A * 5/1977 Taylor ..... F03G 1/00 185/11
4,021,023 A * 5/1977 Berg ..... B01F 11/0034 366/211
(Continued)

FOREIGN PATENT DOCUMENTS

CN 2509700 Y 9/2002
CN 2814647 9/2006
(Continued)

OTHER PUBLICATIONS

State Intellectual Property Office of the P.R. China, International Search Report & Written Opinion issued in corresponding Application No. PCT/CN2018/105826, dated Nov. 14, 2018, 8 pp.
(Continued)

*Primary Examiner* — Rexford N Barnie
*Assistant Examiner* — Xuan Ly
(74) *Attorney, Agent, or Firm* — Greenberg Traurig, LLP

(57) ABSTRACT

Implementations of the subject matter described herein provide a switching apparatus including an energy storage changement mechanism that can realize the main shaft energy storage and direction changement by using only one solenoid. Furthermore, the switching apparatus can be adopted in both two position ATS and three position ATS to satisfy different application scenarios or different market requirements. In addition, all transfers can be achieved by independent manual and electric operation, and each transfer action only requires powering a single solenoid.

15 Claims, 7 Drawing Sheets

(51) Int. Cl.
*H01H 3/30* (2006.01)
*H01H 5/06* (2006.01)
*H01H 9/26* (2006.01)

(52) U.S. Cl.
CPC ..... *H01H 9/26* (2013.01); *H01H 2001/223* (2013.01); *H01H 2300/018* (2013.01)

(56) References Cited

U.S. PATENT DOCUMENTS

| | | | | |
|---|---|---|---|---|
| 8,735,754 | B2 | 5/2014 | Yoshida et al. | |
| 2018/0301309 | A1* | 10/2018 | Sun | H01H 71/10 |

FOREIGN PATENT DOCUMENTS

| | | | | |
|---|---|---|---|---|
| CN | 2922087 | | * | 7/2007 |
| CN | 2922087 | Y | | 7/2007 |
| CN | 101127278 | A | | 2/2008 |
| CN | 101246782 | | | 8/2008 |
| CN | 201112159 | | | 9/2008 |
| CN | 201741617 | | | 2/2011 |
| CN | 102426944 | | | 4/2012 |
| CN | 204270907 | U | | 4/2015 |
| CN | 204905074 | | * | 12/2015 |
| CN | 204905074 | U | | 12/2015 |
| CN | 206353495 | U | | 7/2017 |
| KR | 20100020180 | A | | 2/2010 |
| WO | 2008124773 | A2 | | 10/2008 |
| WO | 2011125120 | A1 | | 7/2013 |

OTHER PUBLICATIONS

European Extended Search Report issued on EP Application No. 18855881.1 dated May 19, 2021.

Chinese Office Action and Search Report, issued by the China National Intellectual Property Administration [SIPO], regarding corresponding patent application Serial No. 201710835500.0; dated Jan. 19, 2022; 10 pages (with English translation).

* cited by examiner

SWITCHING APPARATUS

CROSS-REFERENCE TO RELATED PATENTS

This application claims priority from Chinese Invention Patent Application No. 201710835500.0 with the invention name "Switching Apparatus" filed on Sep. 15, 2017, the entire contents of which are incorporated herein by reference and form a part of this application.

FIELD

Various embodiments of the present disclosure relate to a switching apparatus.

BACKGROUND

Electrical automatic transfer switch (ATS) is widely used in power distribution system. ATS can detect and monitor the power quality, and transfer supply between normal and standby power sources. Such supply transfer requires a mechanism to enable a forward and reverse motion.

Traditional ATS is composed of two electrical switches connected with a set of mechanical and electrical interlocking devices. Due to the large number of components, complicated structure, unreliable interlocking and vulnerability to faults, such traditional ATS becomes less and less used in engineering fields.

One-piece PC level ATS only includes a set mechanism, double-throw contact, and an integrated controller. Its high integrity, simple structure, small volume, fast action, safe and reliable performance make it becomes the development trend of the future. However, the implementation of the forward and reverse motion in one mechanism is still challenging.

Motor can easily move in forward and reverse direction, and thus it was used to directly drive the main shaft in early transfer switches. However, motor action is relatively slow, thereby the motor-based mechanism may not be suitable for rapid switching. On the contrary, solenoid enables fast action, but it can only move in one direction. In an conventional solution, two solenoids are used to drive the main shaft, one for forward motion and the other for reversed motion. However, due to the high price of solenoid, such two solenoids based solution is usually not cost effective. Therefore, there are always expectations of achieving a fast, reliable and cost-effective changement mechanism with compactness and simple structure.

Moreover, ATS can be designed and constructed to be two working position switch or three working position switch, depending on different application scenarios or different market requirements (For example, in UL market, only the two position switch is allowed, while for other markets such as IEC and GB, there is more demand for the three position switch). For three working position switch, the contact can stop at an off position that is not connected with any power source, while for two working position switch, the contact just moves between two sources without any stop in the middle. However, majority of the currently available ATSs in the market cannot be adapted to be used in both two position scenarios and three position scenarios.

Furthermore, independent operation becomes more and more meaningful, especially for the manual operation. Normally, switch can only break or load under the electrical operation, since electrical operation can provide high speed which is helpful and sometimes required for contact breaking and making. Therefore, it is also expected to achieve an independent manual operation switch that can enable a contact speed as high as the electric operation, regardless of the user's hand operation speed.

Some conventional two position ATS having one solenoid has simple construction and enables transfer contact under 30 ms in electric operation. However, in the manual mode, the contact transfer time is completely dependent on the hand operation speed. WO2008/124773A illustrates a three-position actuator where two sets the two position actuators are connected with each other via a link. An additional handle operation mechanical can connect the two sets contact, and drive each set contact separately, thus it can provide independent manual operation under three positions. WO2011/125120 illustrates a dual-solenoid actuator (where the actuator is a two position actuator) which supports an independent manual operation. Other dual-solenoid actuators can be found from CN 200720112341, CN200710073339, CN 200520104092, CN 201020289333, and CN 201110353479.

SUMMARY

Implementations of the subject matter described herein provide a switching apparatus including an energy storage changement mechanism that can realize the main shaft energy storage and direction changement by using only one solenoid. Furthermore, the switching apparatus can be adopted in both two position ATS and three position ATS to satisfy different application scenarios or different market requirements. In addition, all transfers can be achieved by independent manual and electric operation, and each transfer action only requires powering a single solenoid.

In first aspect, a switching apparatus for use in a switch is provided. The switching apparatus comprises: a solenoid including a moving core; a support plate including a V-shaped groove and coupled to the solenoid; a main shaft rotatably arranged on the support plate; a push rod operable to cause a rotation of the main shaft, a first end of the push rod being connected to the moving core, a second end of the push rod being coupled to the V-shaped groove and movable within the V-shaped groove in association with a movement of the moving core; and a main spring coupled between the main shaft and the solenoid, and operable to facilitate the main shaft to reach a rotational position corresponding to an operating position of the switch.

In some implementations, the main shaft includes two cantilevers, and the main shaft is rotated in response to a contact of the second end of the push rod with one of the cantilevers.

In some implementations, the switching apparatus further comprises: a swinging rod arranged on the main shaft, the swinging rod including two guiding edges for determining a movement direction of the second end within the V-shaped groove, based on a contact of the second end to a first guiding edge or a second guiding edge; and a secondary spring coupled between the main shaft and the swinging rod, the secondary spring being operable to cause the swinging rod to rotate in association with the rotation of the main shaft.

In some implementations, the swinging rod is coaxially arranged with the main shaft.

In some implementations, the switching apparatus further comprises: a block arranged in proximity of the swinging rod, the block being operable to limit a rotation of the swinging rod within a predefined angular range.

In some implementations, the swinging rod further includes two restricting edges substantially opposite to the two guiding edges; and the block is arranged between the two restricting edges, and operable to limit the rotation range of the swinging rod via a contact of the block with one of the restricting edges.

In some implementations, the secondary spring is a torsion spring.

In some implementations, wherein the secondary spring is a tension spring, and wherein the switching apparatus further comprises a spring frame operable to couple the tension spring to the main shaft.

In some implementations, the solenoid is operable to power off in response to the main shaft arriving at a critical position beyond which the main spring is allowed to release stored spring energy.

In some implementations, the switching apparatus further comprises: a transmission shaft coupled with the main shaft; a first shaft linkage coaxially arranged with the transmission shaft; and a second shaft linkage coupled between the first shaft linkage and an output axis of the switch, wherein the first shaft linkage includes a first clearance to allow the transmission shaft to rotate within the first shaft linkage for a predefined range, the predefined range corresponds to an angular range of the main shaft rotating from an operating position to a critical position beyond which the main spring is allowed to release stored spring energy; and wherein the second shaft linkage includes a second clearance to allow the second shaft linkage to move in association with the first shaft linkage.

In some implementations, the transmission shaft and the main shaft are integrally formed.

In some implementations, the switching apparatus further comprising: a handle lever coaxially arranged with the output axis and rotatable in association with a rotation of the output axis, the handle lever being coupled to the transmission shaft via a link, the link including a third clearance to allow the handle lever to move in association with the link.

In some implementations, the switching apparatus further comprising: a secondary solenoid including a secondary moving core; and a hook including a first end and an opposite second end, the first end being coupled to the secondary moving core, the second end being operable to interact with an axis lever arranged on the output axis, to lock the output axis at an off position at which the release of stored spring energy is prevented, wherein a location of the off position is determined at least based on the first clearance and the third clearance.

In some implementations, the secondary solenoid is operable to release a lock between the axis lever and hook by moving the secondary moving core in response to receiving a control signal from a controller of the switch.

In some implementations, the switching apparatus, further comprising a first cam and a second cam operable to unlock the hook from the axis lever in response to a manual operation on the handle lever.

In some implementations, the output axis and the first shaft linkage forms a modified Geneva wheel structure.

It is to be understood that the Summary is not intended to identify key or essential features of implementations of the subject matter described herein, nor is it intended to be used to limit the scope of the subject matter described herein. Other features of the subject matter described herein will become easily comprehensible through the description below.

BRIEF DESCRIPTION OF THE DRAWINGS

The above and other objectives, features and advantages of the subject matter described herein will become more apparent through more detailed depiction of example implementations of the subject matter described herein in conjunction with the accompanying drawings, wherein in the example implementations of the subject matter described herein, same reference numerals usually represent same components.

Throughout the drawings, the same or similar reference symbols are used to indicate the same or similar elements.

DETAILED DESCRIPTION

The subject matter described herein will now be discussed with reference to several example implementations. It should be understood these implementations are discussed only for the purpose of enabling those skilled persons in the art to better understand and thus implement the subject matter described herein, rather than suggesting any limitations on the scope of the subject matter.

Figure 1:
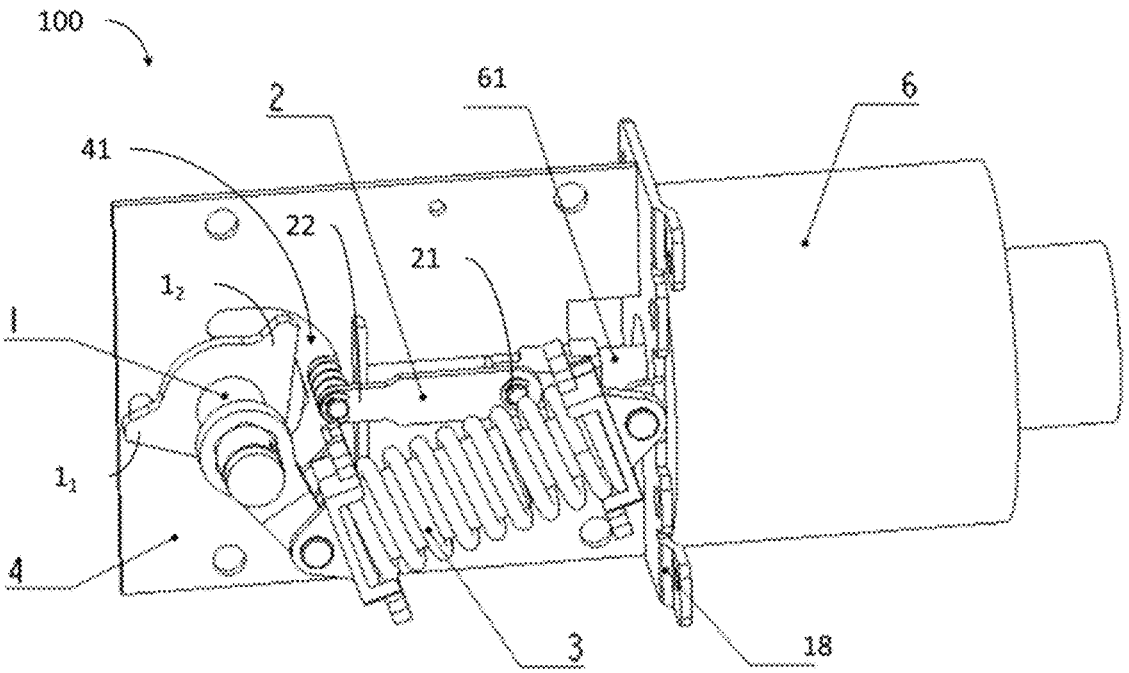
FIG. 1 is the front view of the switching apparatus for use in a two-position ATS, according to an implementation of the present disclosure.

FIG. 1 illustrates a switching apparatus 100 for use in a two-position ATS. Generally, the switching apparatus 100 includes a solenoid 6, a support plate 4 having a V-shaped groove 41, a main shaft 1, a push rod 2, and a main spring 3. As further shown in FIG. 1, the solenoid 6 includes a moving core 61, the support plate 4 is coupled to the solenoid 6 via a switch support 18 connecting to an end surface of the solenoid 6, and the main shaft 1 is rotatably arranged on the support plate 4.

The push rod 2 is operable to cause the rotation of the main shaft 1, and the rotational position of the main shaft 1 is relating to the contact position of the switch. Specifically, the push rod 2 is driven by the moving core 7 of solenoid 6.

In this example, one end 21 of the push rod 2 is connected to the moving core 61, and the other end 22 of the push rod 2 is coupled to the V-shaped groove 41. In this way, along with the movement of the moving core 61, the push rod 2 is moved within the V-shaped groove 41 in a restricted manner. In some implementations, a roller might be arranged on the top of push rod 2, to couple to the V-shaped groove 41.

Still referring to FIG. 1, the main spring 3 as a component for storing and releasing energy is coupled between the main shaft 1 and the solenoid 6. The main spring 3 is operable to facilitate the main shaft 1 to finally reach the rotational position corresponding to an operating position (Power I or II) of the switch from a zero position P0. In this context, the zero position P0 defines a critical position, beyond which the main spring 3 is allowed to release stored spring energy. In this example, one end of the main spring 3 is connected to the switch support 18, and the other end of the main spring 3 is coupled to the main shaft 1.

Figure 2:
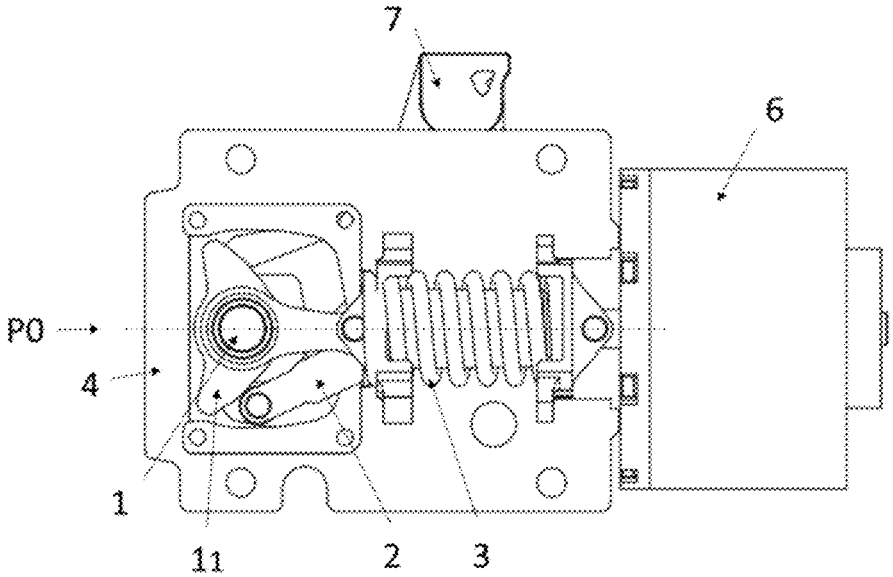
FIG. 2 shows the status of the main spring at zero position, according to an implementation of the present disclosure.

Now referring to FIG. 2. FIG. 2 shows the status of main spring 3 at the zero position P0. In this example, the solenoid 6 pushes main shaft 1 to rotate from an operating position, and the rotation of the main shaft 1 will compress the main spring 3 to charge. When the two terminals of the main spring 3 are in a line with main shaft rotation center as shown in FIG. 2 (indicated by "P0"), the charge is completed. After that, the main spring 3 will start releasing itself automatically and thus cause the main shaft 1 to rotate.

Referring back to FIG. 1, in some implementations, the main shaft 1 may include two cantilevers $\mathbf{1}_1$, $\mathbf{1}_2$, and thus the main shaft 1 can be rotated in response to a contact of the second end 22 of the push rod 2 with one of the cantilevers $\mathbf{1}_1$, $\mathbf{1}_2$. It is to be understood that the shape or profile of the cantilevers and the V-shaped groove as shown in FIG. 1 is only an example, and they can be further optimized in accordance to actual requirements. For example, a U-shaped groove with a relatively flatter bottom surface might be used in some application scenarios. As such, the pushing force applied on the cantilevers can be properly adjusted and optimized.

Figure 3:
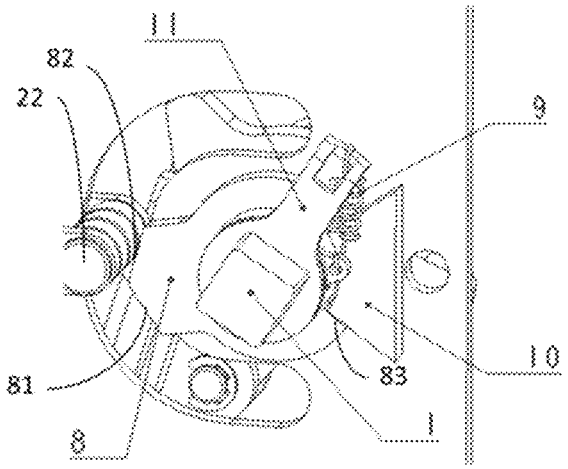
FIG. 3 shows a partial view of the switching apparatus, according to an implementation of the present disclosure.

Now referring to FIG. 3, the switching apparatus 100 further includes a swinging rod 8 arranged on the main shaft 1. In some implementations, the swinging rod 8 can be coaxially arranged with the main shaft 1. In this example as shown in FIG. 2, the swinging rod 8 has two guiding edges 81, 82 for determining a movement direction of the second end 22 within the V-shaped groove 41, and which side of the groove 41 the second end 22 will move to is dependent on which guiding edge the second end 22 is to contact with.

As further illustrated in FIG. 3, the switching apparatus 100 further includes a secondary spring 9 (hereafter may also be referred to as direction-changing spring) that is coupled between the main shaft 1 and the swinging rod 8. The secondary spring 9 is operable to cause the swinging rod 8 to rotate in association with the rotation of the main shaft 1.

In some implementations, as shown in FIG. 3, the secondary spring 9 is a tension spring or a compression spring, and the switching apparatus 100 further includes a spring frame 11 for coupling the tension spring to the main shaft 1. Normally, a tension spring or a compression spring may provide improved control accuracy.

In some other implementations, the secondary spring 9 may be a torsion spring. A torsion spring enables a simplified direction-changing mechanism, as it could be directly coupled between the main shaft 1 and the swinging rod 8 with no spring frame 11 being required.

In some implementations, the switching apparatus 100 further includes a block 10 that is arranged in proximity of the swinging rod 8. The block 10 is used to limit a rotation of the swinging rod 8 within a predefined angular range. In an example embodiment as illustrated in FIG. 3, the swinging rod 8 has two restricting edges 83, 84 (in this example, only the restricting edge 83 can be seen) that are substantially opposite to the two guiding edges 81, 82. The block 10 is arranged between the two restricting edges 83, 84 to limit the rotation range of the swinging rod 8 through the contact of the block 10 with one of the restricting edges 83, 84 in a given rotation direction.

In the following, the operation mechanism of the direction change of the main shaft 1 will be illustrated in details with reference to FIG. 4-FIG. 9.

Figure 4:
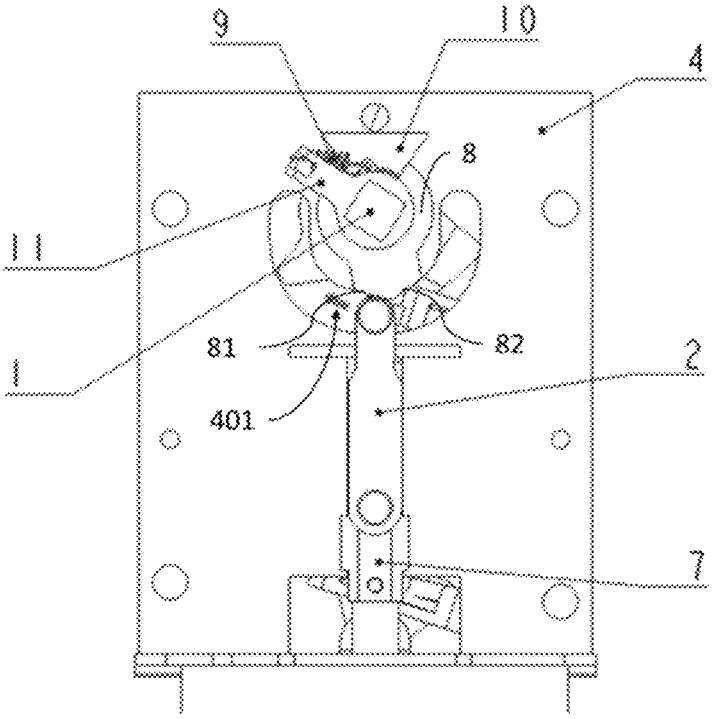
FIG. 4 illustrates an intermediate status where the push rod touches a guiding edge of swinging rod, according to an implementation of the present disclosure.

Referring to FIG. 4, initially, when the solenoid 6 is energized (or power on), the moving core 7 will drive the push rod 2 to move outward. Due to the orientation of the swinging rod 8, the end 22 of the push rod 2 can only contact with the first guiding edge 81 of the swinging rod 8. Hence, the push rod 2 will be guided by the first guiding edge 81 to the corresponding side of V-shaped groove with no hindrance (the guiding direction of the push rod 2 in this example is indicated by the arrow 401). As it is illustrated in FIG. 4, the side with no hindrance (in this example, the left hand side) is opposite to the orientation of the currently released main spring 3. In fact, the first guiding edge 81 and the second guiding edge 82 together form a tip, and such tip prevents the push rod 2 from moving to the other side of the V-shaped groove (that is, the right hand side).

Figure 5:
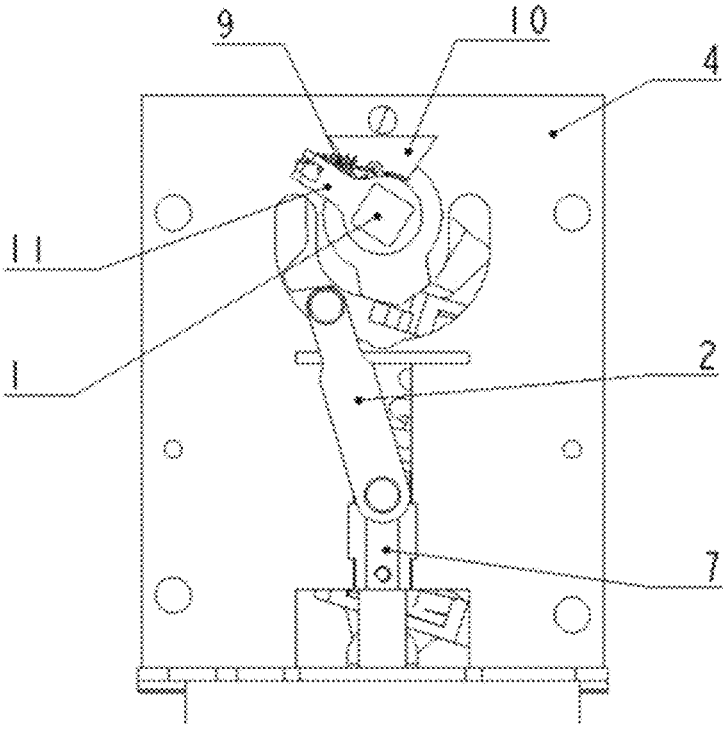
FIG. 5 illustrates an intermediate status where the swinging rod is being driven by the push rod to rotate, according to an implementation of the present disclosure.

Now referring to FIG. 5, with the movement of the second end 2 of the push rod 2 within the V-shaped groove 41 along the guided direction 401, once the second end 22 of the push rod 2 touches with the cantilever $\mathbf{1}_1$, the main shaft 1 will be driven to rotate and meanwhile, the main spring 3 will be compressed to charge.

Figure 6:
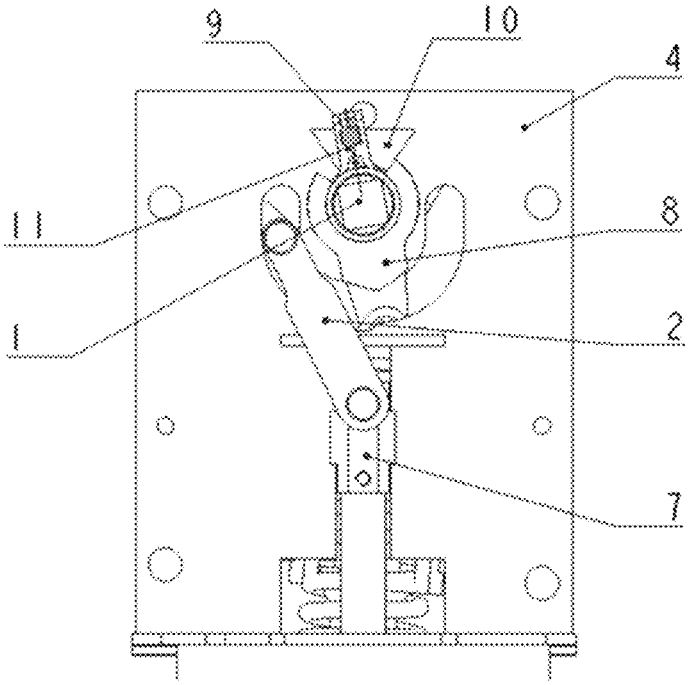
FIG. 6 illustrates an intermediate status where the swinging rod starts rotating with the main shaft, according to an implementation of the present disclosure.

Continuing to refer to FIG. 6, now if the whole rotation range of the swinging rod 8 is defined as $\theta$, once the main shaft 1 reaches a point at which the main shaft 1 forms an angle of $\theta/2$ with respect to the symmetric line, the two terminals/ends of the tension spring 9 are in line with the rotation center of the main shaft 1. After the tension spring 9 is in line with the rotation center of the main shaft 1, the swinging rod 8 will begin to move together with main shaft 1 till the main shaft 1 passes over the zero position P0 for another angle of $\theta/2$, then the swinging rod 8 will be stopped by block 10.

Figure 7:
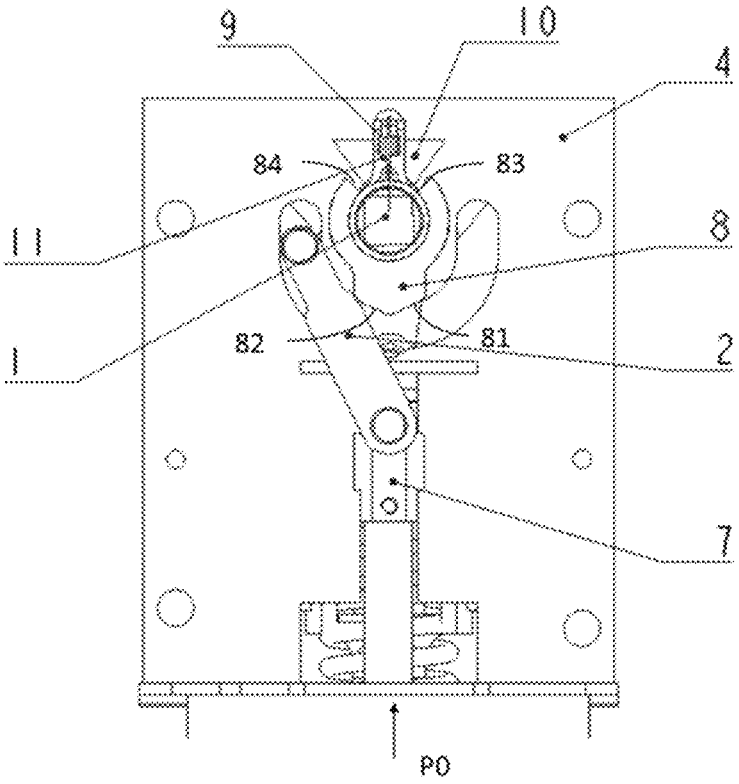
FIG. 7 illustrates an intermediate status of the zero position, according to an implementation of the present disclosure.

FIG. 7 illustrates the intermediate status where the main shaft 1 reaches the zero position P0, and the charging to the main spring 3 is finished. As discussed above, then the main spring 3 will be automatically released to drive main shaft 1 to continue rotating to the other side, and the swinging rod 8 follows the rotation of the main shaft 1.

Compared to those changement mechanisms relying to the inertia of shaft, where the further rotation passing over the zero position P0 can be achieved by means of its own inertia, the direction changing mechanism of the present disclosure enables a simple construction and more reliable direction changing mechanism. Furthermore, compared to those changement mechanisms relying an additional small solenoid to facilitate pushing the shaft a little more at the zero position, this direction changing mechanism of the present disclosure does not require an additional solenoid and thus can realize the direction change in a more cost-effective way.

Figure 8:
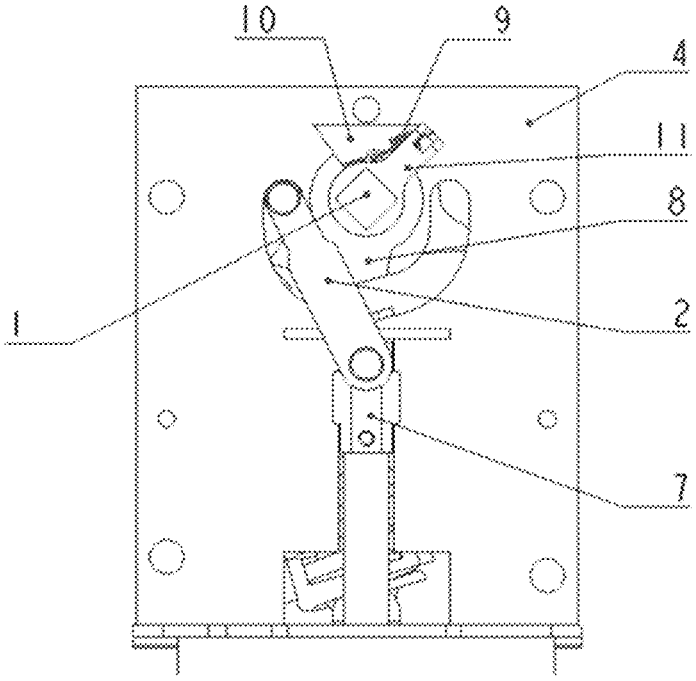
FIG. 8 illustrates an intermediate status where the main spring starts to release and push main shaft to continue rotating, according to an implementation of the present disclosure.

In some implementations of the present disclosure, the solenoid 6 can be operable to power off in response to the main shaft 1 arriving at a critical position P0. In some other implementations as shown in FIG. 8, the push rod 2 may keep moving forward a little, even after the main shaft 1 has reached the zero position P0, in order to ensure the main spring 3 to be released towards the other side, rather than going backwards. It is to be understood that such action will not affect the release of the main shaft 1 to the other side, if the main spring 3 can be released faster than the push rod 2. If so, the fast-moving cantilever on the main shaft 1 will be away from the second end 22 of push rod 2, and the main spring 3 will still be independently released. Otherwise, the push rod 2 will continue applying force on the cantilever to assist the rotation of the main shaft 1. Alternatively, the movement of push rod 2 can be controlled to stop a little in the movement, until the main shaft 1 is fully released. In sum, there is no need to accurately control the powering time of the moving core 61, which enables a simple control to the solenoid.

Figure 9:
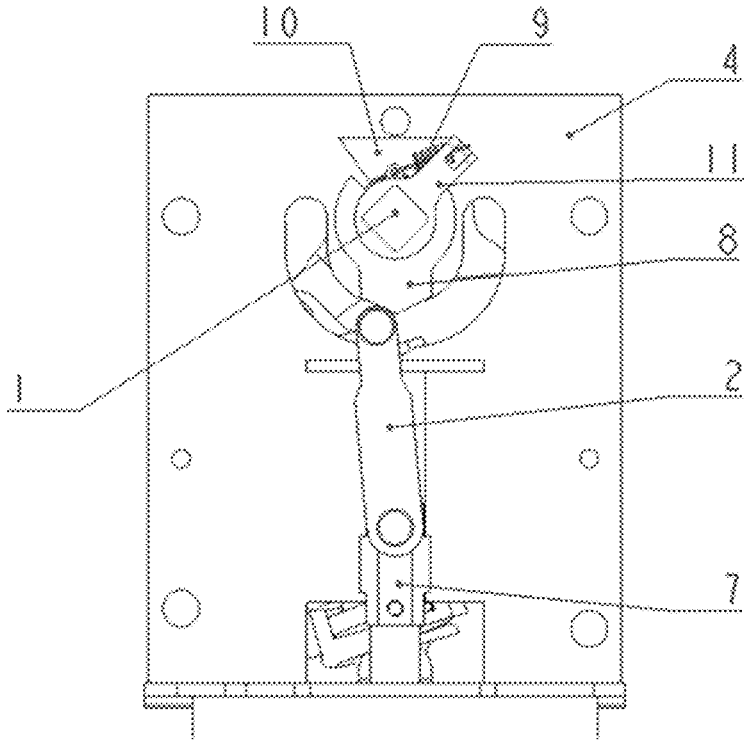
FIG. 9 illustrates an intermediate status where the push rod is being recovered.

Referring to FIG. 9, after the solenoid 6 losing power, the recovery spring inside the solenoid 6 will pull the moving core 7 as well as the push rod 2 back. In this process, push rod 2 will touch and push swinging rod 8 away a little as shown in FIG. 9, then move back to the bottom of the V-shaped groove. After the push rod 2 losing contact with the swinging rod 8, the swinging rod 8 could be recovered by tension spring 9 back to the orientation as shown in FIG. 8.

So far, whole energy storage changement action is completed. In the next action of solenoid 6, the mechanism will repeat the above actions and change main shaft 1 to the other side.

Figure 10:
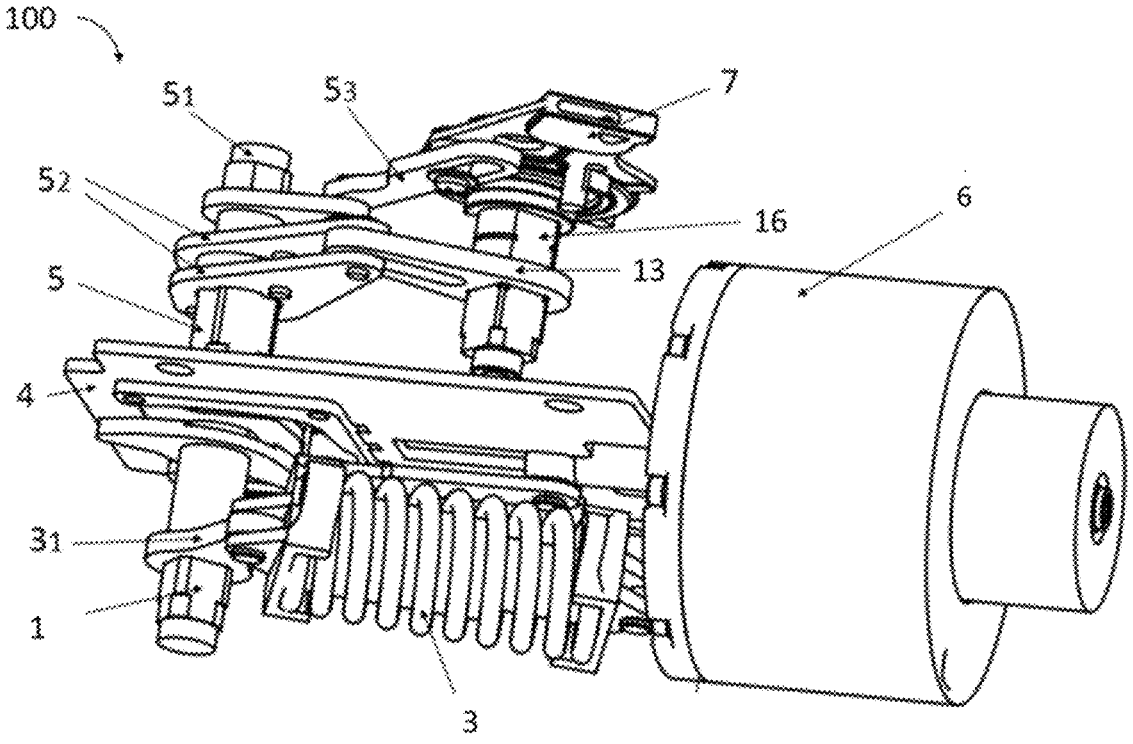
FIG. 10 illustrates the switching apparatus for use in a two position ATS according to an implementation of the present disclosure.

Now referring to FIG. 10, in some implementations, the switching apparatus 100 further includes: a transmission shaft 5 coupled with the main shaft 1, a first shaft linkage $\mathbf{5}_2$ coaxially arranged with the transmission shaft 5, and a second shaft linkage 13 coupled between the first shaft linkage $\mathbf{5}_2$ and an output axis 16 of the switch.

In some implementations, the transmission shaft 5 and the main shaft 1 are rigidly connected, so that so they also can be defined as one shaft. In some implementations, the transmission shaft 5 and the main shaft 1 are integrally formed.

Figure 11A:
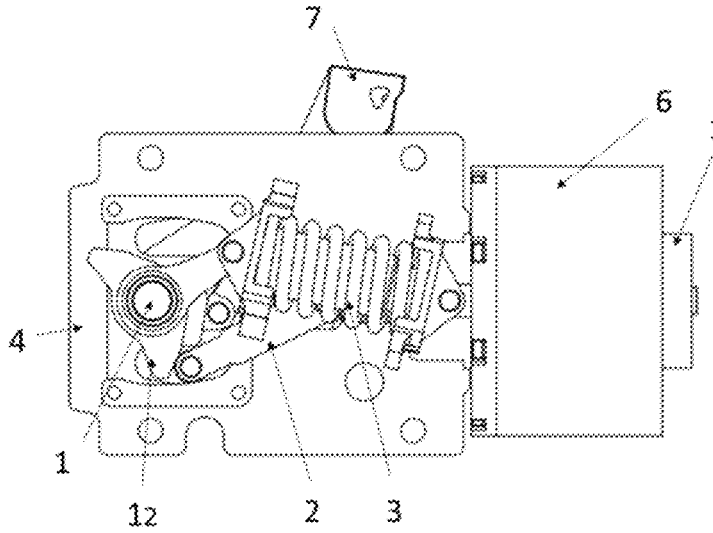
FIGS. 11A-11B show an intermediate status of charging main spring according to an implementation of the present disclosure.
Figure 11B:
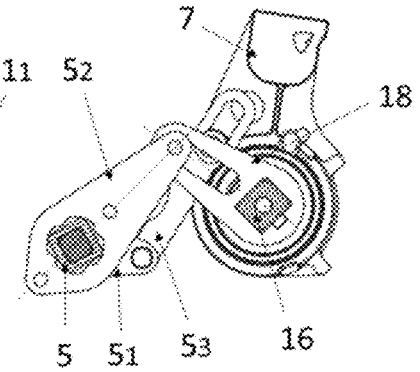

As illustrated in FIGS. 11A-11B, the first shaft linkage $\mathbf{5}_2$ includes a first clearance C1 to allow the transmission shaft 5 to rotate within the first shaft linkage $\mathbf{5}_2$ for a predefined range, and the predefined range corresponds to an angular range of the main shaft 1 rotating from an operating position to the zero position P0. In other words, once the main spring 3 passes the zero position P0, the clearance will be vanished. In addition, the second shaft linkage 13 includes a second clearance C2 to allow the second shaft linkage 13 to move in association with the first shaft linkage 52.

As further illustrated in FIGS. 11A-11B, in some implementations, the switching apparatus 100 further includes: a handle lever 7 that is coaxially arranged with the output axis 16 and rotatable in association with the rotation of the output axis 16 (that is, the output shaft 16 can be driven by shaft-linkage lever 52). The handle lever 7 is further coupled to the transmission shaft 5 via a link $\mathbf{5}_3$, and the link $\mathbf{5}_3$ includes a third clearance C3 to allow the handle lever 7 to move in association with the link $\mathbf{5}_3$.

Next, the action principle of two position under electric operation will be described with reference to FIG. 12. Initially, assume the contact is on supply I. When main solenoid 6 is power on, the moving core 61 will drive the rod 2 to rotate the main shaft 1, and thereby starting the charging to the main spring 3. Before reaching the zero position P0 of main spring 3, the output axis 16 keeps stay due to the angle clearance C1 between shaft 5 and lever 52 which inside shaft-linkage. Again, once the main spring 3 passes zero position and starts to release, the clearance is vanished and output axis 16 starts moving, then the contact will be breaking and making to supply II. The transfer from supply II to supply I same as above process.

The action principle of two position ATS under manual operation is described as follows: handle 7 is operated by a user to drive main shaft 1 to rotate, then same as that occurred in the electric operation, the output axis 6 stays until the main spring 3 reaches the zero position P0, and starts moving because the clearance C1 is vanished. Obviously, the contact transfer for both manual operation and electric operation is always achieved by the main spring 3, and the only difference between those two operational modes is that the main shaft 3 is rotated manually or by powering the main solenoid 6. This means, the transfer speed is completely relied on the main spring 3, no matter the operation is performed by hand or electricity, thereby achieving an independent manual operation switch that can enable a contact speed as high as the electric operation.

Figure 12A:
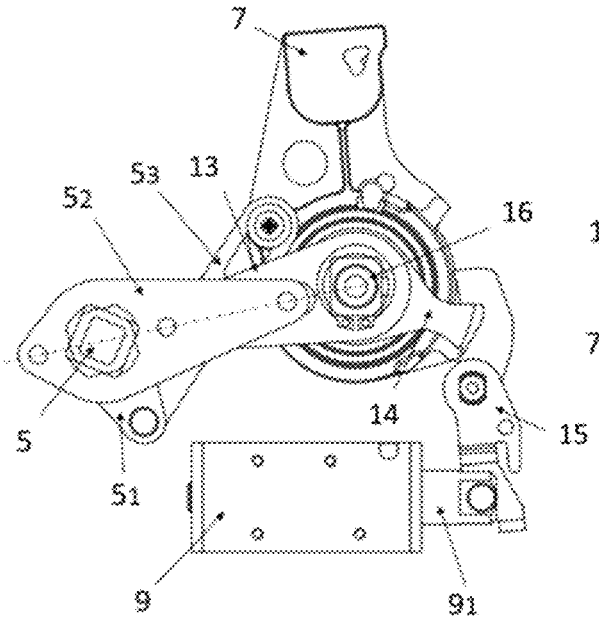
FIGS. 12A-12B show the addition parts for three position actuator.
Figure 12B:
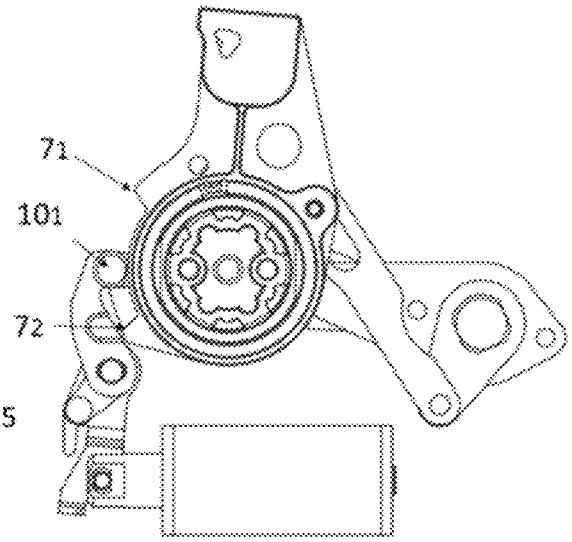

Now referring to FIGS. 12A-12B. In some implementations, the switching apparatus 100 can also be used as a three position ATS, when adding some additional parts into two position actuator. As shown in FIGS. 12A-12B, the switching apparatus 100 may further include: a secondary solenoid 9 including a secondary moving core $\mathbf{9}_1$, and a hook 15 including a first end and an opposite second end. The first end is coupled to the secondary moving core $\mathbf{9}_1$, and the second end is operable to interact with an axis lever 14 arranged on the output axis 16, to lock the output axis 16 at an off position.

For example, during transfer from Power I to Power II under this three position actuator, when the output axis 16 moves half way, the axis lever 14 will touch with one surface of hook 15, then contact stop in the middle of two supplies at an off position. At the off position, the release of stored spring energy is terminated.

After arriving at the off position, there are two options. One option is operating a controller of the switch to power the secondary solenoid 9 on, in order to pull the hook 10 back for releasing the axis lever 14, then the main spring 3 will continue to release and drive output axis 16 till the contact close to supply II. Another option is operating the controller to power the main solenoid 6 on, then the main shaft 1 will rotate back to charge main spring 3 and pass zero position P0 again. In this way, the contact will close back to supply I.

In some implementations, the switching apparatus 100 further includes a first cam $\mathbf{7}_1$ and a second cam $\mathbf{7}_2$ operable to unlock the hook 15 from the axis lever 14 in response to a manual operation on the handle lever 7. In the example as shown in FIG. 12B, during the manual operation, the cam $\mathbf{7}_1$ or $\mathbf{7}_2$ on handle shaft 7 will press pin 101 of hook 10 to release output axis 6.

Figure 13:
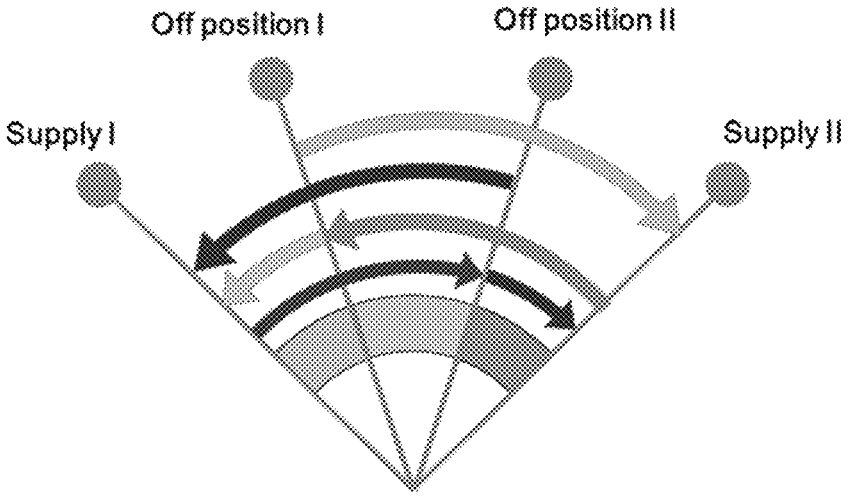
FIG. 13 indicates the four positions of main shaft and the logic control for three work positions.

For the case of a three position actuator in the present disclosure, the off position is realized through stopping the main spring 3 to release. Therefore, principally there should be four positions for main shaft 1 as illustrated in FIG. 13, that is, two supply positions S1, S2, and two off positions O1, O2. However, due to the angle clearance C1 inside shaft-linkage $\mathbf{5}_2$, and the third clearance C3 between handle shaft 7 and link $\mathbf{5}_3$, the two off positions are substantially coincident on output axis 16. In other words, due to the angle clearance C1 and third clearance C3, the two off position can be close to each other or coincide with each other.

As discussed above, the release solenoid 9, off position hook 10, axis lever 11 and other auxiliary parts are additional components, and they can be optionally assembled to the two position ATS to realize a three position ATS during the production line. Even the actuator has been assembled as a three position ATS, users just need to, for example, tight one screw to lock the core 91. In this way, the hook 10 for defining the off position will not work, and the contact of the switch will just pass the off position and go to close.

In this way, all functions of the actuators are the same, even the operation position of handle are the same for the two position case, so the user will not identify, just from appearance, whether it is a two position ATS or a three position ATS.

In some embodiments, the connection between output axis 6 and linkage 52 is actually a modified Geneva wheel structure. When the connection angle in between is lower than 90°, a self-locking structure can be formed to keep the contact close. It is very useful especially for bat contact system in which a big electrodynamic reaction force exists.

As used herein, the term "includes" and its variants are to be read as open terms that mean "includes, but is not limited to." The term "based on" is to be read as "based at least in part on." The term "one implementation" and "an implementation" are to be read as "at least one implementation." The term "another implementation" is to be read as "at least one other implementation." The terms "first," "second," and the like may refer to different or same objects. Other definitions, explicit and implicit, may be included below. A definition of a term is consistent throughout the description unless the context clearly indicates otherwise.

We claim:

1. A switching apparatus for use in a switch, comprising:
- a solenoid including a moving core;
- a support plate including a V-shaped groove and coupled to the solenoid;
- a main shaft rotatably arranged on the support plate;
- a push rod operable to cause a rotation of the main shaft, a first end of the push rod being connected to the moving core, a second end of the push rod being coupled to the V-shaped groove and movable within the V-shaped groove in association with a movement of the moving core;
- a main spring coupled between the main shaft and the solenoid, and operable to facilitate the main shaft to reach a rotational position corresponding to an operating position of the switch;
- a swinging rod arranged on the main shaft, the swinging rod including two guiding edges for determining a movement direction of the second end within the V-shaped groove, based on a contact of the second end to a first guiding edge or a second guiding edge; and
- a secondary spring coupled between the main shaft and the swinging rod, the secondary spring being operable to cause the swinging rod to rotate in association with the rotation of the main shaft.

2. The switching apparatus of claim 1, wherein the main shaft includes two cantilevers, and the main shaft is rotated in response to a contact of the second end of the push rod with one of the cantilevers.

3. The switching apparatus of claim 1, wherein the swinging rod is coaxially arranged with the main shaft.

4. The switching apparatus of claim 1, further comprising:
- a block arranged in proximity of the swinging rod, the block being operable to limit a rotation of the swinging rod within a predefined angular range.

5. The switching apparatus of claim 4, wherein
- the swinging rod further includes two restricting edges substantially opposite to the two guiding edges; and
- the block is arranged between the two restricting edges, and operable to limit the rotation range of the swinging rod via a contact of the block with one of the restricting edges.

6. The switching apparatus of claim 1, wherein the secondary spring is a torsion spring.

7. The switching apparatus of claim 1, wherein the secondary spring is a tension spring, and wherein the switching apparatus further comprises a spring frame operable to couple the tension spring to the main shaft.

8. The switching apparatus of claim 1, wherein the solenoid is operable to power off in response to the main shaft arriving at a critical position beyond which the main spring is allowed to release stored spring energy.

9. The switching apparatus of claim 1, further comprising:
- a transmission shaft coupled with the main shaft;
- a first shaft linkage coaxially arranged with the transmission shaft; and
- a second shaft linkage coupled between the first shaft linkage and an output axis of the switch,
- wherein the first shaft linkage includes a first clearance to allow the transmission shaft to rotate within the first shaft linkage for a predefined range, the predefined range corresponds to an angular range of the main shaft rotating from an operating position to a critical position beyond which the main spring is allowed to release stored spring energy; and
- wherein the second shaft linkage includes a second clearance to allow the second shaft linkage to move in association with the first shaft linkage.

10. The switching apparatus of claim 9, wherein the transmission shaft and the main shaft are integrally formed.

11. The switching apparatus of claim 9, further comprising:
- a handle lever coaxially arranged with the output axis and rotatable in association with a rotation of the output axis, the handle lever being coupled to the transmission shaft via a link, the link including a third clearance to allow the handle lever to move in association with the link.

12. The switching apparatus of claim 11, further comprising:
- a secondary solenoid including a secondary moving core; and
- a hook including a first end and an opposite second end, the first end being coupled to the secondary moving core, the second end being operable to interact with an axis lever arranged on the output axis, to lock the output axis at an off position at which the release of stored spring energy is prevented,
- wherein a location of the off position is determined at least based on the first clearance and the third clearance.

13. The switching apparatus of claim 12, wherein the secondary solenoid is operable to release a lock between the axis lever and hook by moving the secondary moving core in response to receiving a control signal from a controller of the switch.

14. The switching apparatus of claim 12, further comprising a first cam and a second cam operable to unlock the hook from the axis lever in response to a manual operation on the handle lever.

15. The switching apparatus of claim 9, wherein the output axis and the first shaft linkage forms a modified Geneva wheel structure.

* * * * *